United States Patent [19]

Fritzvold

[11] 4,278,496

[45] Jul. 14, 1981

[54] METHOD FOR BLEACHING PULP WITH OZONE

[75] Inventor: Bjørn H. Fritzvold, Hosle, Norway

[73] Assignee: Myrens Verksted A/S, Norway

[21] Appl. No.: 57,325

[22] Filed: Jul. 13, 1979

Related U.S. Application Data

[63] Continuation of Ser. No. 900,098, Apr. 26, 1978, abandoned.

[30] Foreign Application Priority Data

Apr. 27, 1977 [NO] Norway ..... 771473
Apr. 27, 1977 [NO] Norway ..... 771474

[51] Int. Cl.[3] ..... B21C 9/10

[52] U.S. Cl. ..... 162/19; 162/65; 162/237

[58] Field of Search ..... 162/17, 19, 18, 65, 162/237, 246; 8/156; 68/181 R

[56] References Cited

U.S. PATENT DOCUMENTS

| | | | |
|---|---|---|---|
| 2,916,346 | 12/1959 | Jalkanen | 8/156 |
| 3,703,435 | 11/1972 | Schleinofer | 162/65 |
| 3,704,603 | 12/1972 | Richter | 68/181 R |
| 3,964,962 | 6/1976 | Carlsmith | 162/237 |
| 4,105,494 | 8/1978 | Pettersson | 162/65 |
| 4,123,317 | 10/1978 | Fritzvold et al. | 162/65 |

FOREIGN PATENT DOCUMENTS 137651 5/1977 Norway .

*Primary Examiner*—William F. Smith
*Attorney, Agent, or Firm*—Holman & Stern

[57] ABSTRACT

In a reactor plant for treating finely divided bulk material an acid bulk material or pulp having a solids content of approximately 35–50% is conveyed to a combined high-consistency ozonizer and maturation reactor as a substantially vertical pulp column forming a gas blocking means. In the transition area between the ozonizer and the maturation reactor the finely divided and ozonized pulp which has a very acid pH-value is mixed with chemicals to a pH-value of approximately 8–11 and to a solids content of approximately 15–20%, at which solids content the alkaline pulp in the form of a continuously advancing column is subjected to a maturation process which terminates at a pH-value of the pulp of 6–7.

11 Claims, 8 Drawing Figures

8
9
7
II
16
II
19
3
20
15
5
4
6
17
21
18
35a
22
35
34
22b
1
22a
23
23b
23a
24
24b
24a
25
25b
25a
26
26b
26a
28
27
30
36
36a
36a
36
4
1
37
B
29
31
33
42
40
A
14
38
10
41
2
11
39
12
13
44
32
5
14
43
45
32a
6
47
46

METHOD FOR BLEACHING PULP WITH OZONE

This is a continuation of application Ser. No. 900,098, filed Apr. 26, 1978 now abandoned.

BACKGROUND OF THE INVENTION

1. Field of the Art

The present invention relates to a method for treating finely divided bulk material, especially fibrous or cellulose containing pulp.

The invention also relates to an apparatus for carrying out the method.

2. Statement of Prior Art

The treatment of finely divided pulp with ozone entials that the pulp has a low pH-value when leaving the ozone treatment apparatus. In order to stabilize the properties of the pulp—especially those developed during the ozone treatment—the pulp is mixed with lye so as to obtain an alkaline pH-value.

For cellulose containing pulps the quantity of lye necessary for achieving a suitable alkaline pH-value as a starting point for the maturation, generally depends on the quantity of ozone which is added to the pulp. When the pulp has matured, the pulp is characterized in that its pH-value will not decrease any more. Depending on what the pulp is to be used for, so large quantities of lye are added to the pulp that its pH-value after the maturation can be slightly alkaline, neutral or even slightly acid.

For chemical pulps (cellulose) the quantity of lye necessary for achieving a suitable alkaline pH-value as a starting point for the maturation, will depend on the type of pulp to be treated (sulphate or sulphite cellulose), the pre-treatment of the chemical pulp and especially its kappa figure before the ozone treatment, i.e. the content of lignine residue in the pulp.

An after-treatment method of ozone treated pulp is known from Norwegian Pat. No. 137.651 (U.S. Pat. No. 4,123,317). However, this method suffers from some disadvantages. Firstly, the supply of lye and water to the ozone treated pulp is carried out to such a degree that the pulp obtains a very low solids content. This entails a relatively long maturation time, and the diluted pulp requires a relatively large volume for storage and further maturation.

Secondly, the maturation of pulp suspensions having a low consistency requires a stirring of the pulp both for achieving prior to the maturation a uniform dispersion of the lye in the pulp, and—during the maturation stage—a uniform distribution of the lye quantities which at any time remain in the suspension, so that the maturation time is kept within an acceptable time schedule. Since the method here is a continuous process, such a stirring will ential that the residence time for the various parts of the pulp in the distribution chamber will vary and the pulp will therefore be subjected to an inhomogenous maturation.

Thirdly, a maturation at low consistency often entails a prolonged gas treatment course, the passing time in the gas treatment reactor having to be kept relatively long for not giving the pulp undesired by-effects, as for example miscolouring.

SUMMARY OF THE INVENTION

The object of the present invention is to give instructions for a method and an apparatus for treating finely divided bulk material in which the above-mentioned disadvantages are eliminated. More specifically, the invention aims at a method and an apparatus for treating finely divided bulk material in which the pulp can be subjected to a maturation process which is more easy to monitor, the total treatment process comprising as well the gas phase treatment as the maturation process being accomplished in a shorter time.

According to the invention, in a method of the type stated in the preamble, this object is achieved by the following steps:

(a) supplying a finely divided pulp having a high solids content and an acid pH-value to a gas treatment reactor, (b) subjecting the finely divided acid pulp to a treatment in the gas treatment reactor whilst its solids content remains approximately unaltered, and whilst its pH-value is further decreased, (c) mixing the very acid ozonized pulp with chemicals containing alkalis at the outlet of the gas treatment reactor, so that the pulp adopts a strongly alkaline pH-value, and (d) subjecting the strongly alkaline ozonized pulp to a maturation process which is to the effect of giving the pulp a decreasing pH-value which is stabilized at an approximately neutral or slightly acid value, the pulp during the maturation process, even after being mixed with chemicals, having a high solids content.

Preferably, the method according to the invention may be carried out by allowing the finely divided pulp to fall past one or more jets of chemicals at the outlet of the reactor, for mixing therewith, and by passing the pulp mixed with chemicals as a substantially vertical column through a container which defines an extension of the gas treatment, for in the form of a column to be subjected to a maturation process.

Subsequent to being subjected to such a column maturation the pulp can either be discharged from the high consistency reactor as a high consistency pulp to a subsequent processing stage, or it can be mixed with diluting water at the outlet of the maturation reactor for in this diluted condition to be transported direct to a subsequent processing stage, for example a paper manufacturing machine.

Since the addition of chemicals, e.g. lye, takes place at a high consistency of the pulp, the maturation of the pulp will develop more uniformly and quicker, because the diffusion process initiating the maturation is effected more rapidly, the driving potential in diffusion transport of pulp being proportional with the difference in the pulp concentration during the reaction.

Such a spraying of the pulp entails that the supplied chemicals are uniformly mixed with the pulp, and the regulation of both the supply of lye and the concentration of pulp is facilitated, since the pulp coming first in contact with the jets, also being first advanced in the process. A simpler control of the residence time which the pulp must have in the subsequent, closed system, is thereby achieved, the residence time being reduced considerably relative to the known stirring maturation taking place in connection with a pulp concentration of approximately 3%.

According to the present invention the maturation can thus commence at a pulp concentration of approximately 15–30%, a fact which is of great economic importance due to the reduced requirement of storage space in the form of a maturation reactor and reduced processing time in the gas phase reactor, the total installation volume at a given capacity thus being very much reduced.

At the outlet of the ozone reactor the ozone treated pulp may be sprayed not only with lye, but also with other liquids, for example bleaching chemicals or complex formers.

An appropriate manner of transporting the pulp to the reactor plant consists in passing the finely divided pulp through a closed conveyor means to the gas treatment reactor as a substantially vertical column having such a length and such a compression as to form a gas block, processing the pulp column to a light and fluffy consistency in the area of the conveyor outlet, and adding gas, for example ozone, to the finely divided pulp in the area of the conveyor outlet, the gas serving for further treatment of the pulp.

Preferably the gas may be added to the pulp so as to impart to it a movement which passes the pulp out of the fluffing and mixing area.

The gas blocking effect is determined by the length and the compression of the pulp column, a long pulp column not requiring the same compression as a short pulp column for the forming of a satisfactory gas block. If a comparatively long column having a relatively low compression is chosen, only a small power is necessary for the after-fluffing of the pulp, a fact which in turn means reduced possibility for overheating and sparking.

A plant for carrying out the method according to the invention can suitably be to the effect that the plant comprises a gas treatment reactor in which the finely divided pulp is treated with gas, preferably ozone without overpressure, and from which the pulp is discharged with a relatively large solids content, and a substantially cylindrical, vertical and closed maturation container having a transition portion connected to the gas treatment reactor to receive gas treated pulp, that the maturation container in the transistor portion is provided with one or more nozzles for the supply of lye and/or other chemicals to the pulp, that the maturation container comprises a portion serving as a conveying path and maturation chamber for the sprayed pulp, and that the container possibly has a lower portion which is equipped with one or more nozzles for the supply of diluting water to the matured pulp and stirring means for stirring the diluted pulp as well as discharge means for removing the diluted pulp to a subsequent processing stage, for example a paper manufacturing machine.

Such a plant makes it possible to mount the gas phase or gas treatment reactor direct above or on the maturation reactor. Thereby, the gravity can be utilized for the transport of the pulp, the combined gas and maturation reactor requiring foundation works which are not larger than what is the case for a common gas phase plant alone.

Preferably the maturation container may define a continuation of the ozone treatment apparatus described in Norwegian Pat. No. 137.651 (U.S. Pat. No. 4,123,317).

A special feature of the plant is to the effect that a closed conveyor is provided for the transport of the finely divided pulp, that the conveyor comprises means for transporting the pulp from its inlet to its outlet as a vertical gas-sealing pulp column, that in the area of the conveyor outlet there is provided a means serving to give the advancing pulp column a light and fluffy consistency, and that in the same area there is provided means for the supply of gas, preferably ozone, serving for further treatment of the pulp.

Preferably the conveyer may be a vertically arranged screw conveyor, and a favourable feature then consists in that the fluffer means is mounted on the rotating shaft of the screw conveyer for rotation therewith.

The combination constituting a vertical screw conveyer and a direct connected after-fluffer permits a shaft speed on the common screw and fluffer shaft of $\leqq 500$ rpm, whereas conventional fluffer machinery in comparison operates in the speed range of 2000–4000 rpm.

The combination comprising a vertical screw conveyer and a fluffer thus permits a far more safe transport and treatment, because the risk for overheating and sparking, which would be quite catastrophic in a gas treatment plant with oxygen and ozone, is reduced to a safe level.

In the following the invention will be described further, reference being had to the drawings.

DESCRIPTION OF THE PREFERRED EMBODIMENTS

Figure 1:
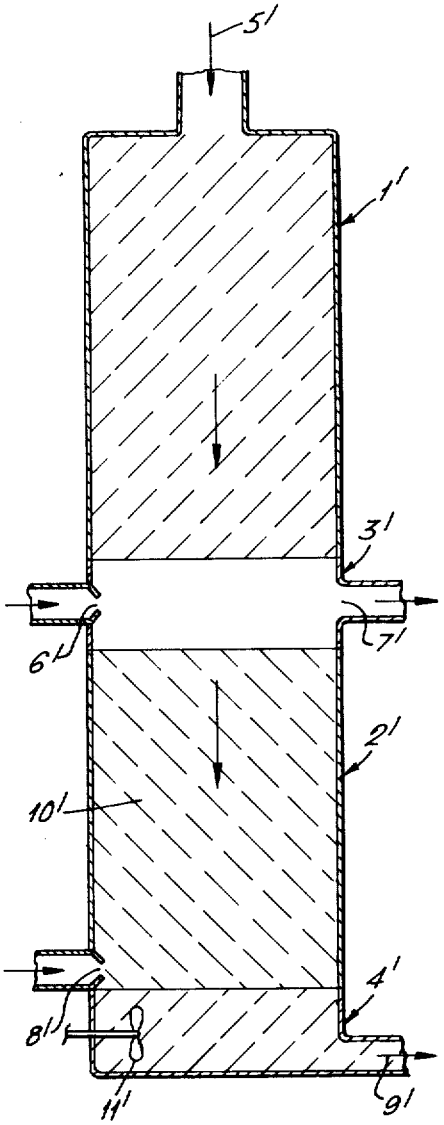
FIG. 1 is a simplified layout of a reactor plant according to the invention.
Figure 1A:
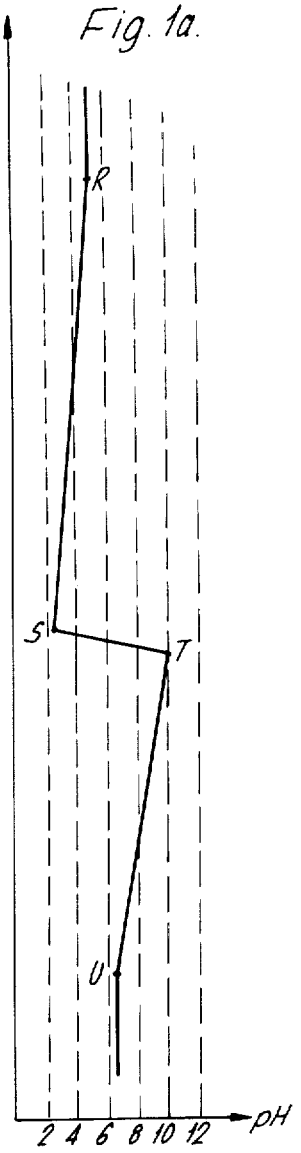
FIG. 1*a* is a graphical representation of the pH-value of the pulp at various stages of the process.

In FIG. 1, 1' designates an ozone reactor consisting of a first cylindrical container, whereas 2' designates a maturatior reactor which comprises a second cylindrical container connected to the ozone reactor 1' via a transition portion 3'.

Finely divided bulk material, for example fibrous or cellulose containing pulp having a pH-value of approximately 5 and a solids content of approximately 35–50%, is supplied to the reactor through a supply device 5' which will be further described in connection with FIG. 2.

$O_2/O_3$-gas is supplied to the reactor together with the pulp or possibly via a further not illustrated supply chamber, so that gas and finely divided pulp are conveyed into the top of the ozone reactor to be distributed across the entire cross section of the reactor. The supplied gas having a volume which is substantially larger than the volume of the pulp, continuously flows through the bulk material across the entire cross section of the reactor, the gas thus coming in intimate contact with all the pulp particles. After having passed through the finely divided material the gas is removed from the ozone reactor 1' through openings 7' in the transition portion 3' between the ozone reactor 1' and the maturation reactor 2' by a not illustrated blower.

The treatment of the finely divided pulp with ozone entails that the pulp has a low pH-value, for example in the range 2–4, when it leaves the ozone reactor 1' at the transition portion 3'. In order to stabilize the qualities of the pulp, especially those procured by the ozone treatment, lye is added to the pulp for thereby achieving an alkaline pH-value. The pulp is then subjected to a so-called maturation process in an alkaline environment, and to maintain the favourable qualities of the pulp achieved by the ozone treatment it is desired to make this maturation time as short as possible, the maturation process having to be controlled and supervised in a simple and effective manner.

It is thus to be understood that a maturation process comprises the adjustment of the pH-value of the pulp and a subsequent stabilization thereof. During the maturation process a series of reactions take place, in which reactions organic and inorganic peroxide developed during the ozonizing process induce an after-bleaching and a further increase of strength of the pulp. Simultaneously acid groups consuming alkalis are developed.

As to mechanical pulps the adjustment of the pH-value is thus of substantial importance, and a pulp which at the starting point —i.e. when leaving the ozonizer—has had its pH-value adjusted to approximately 9–10, is finished treated when its pH-value has become stable in the range of 6–7.

When leaving the ozone reactor 1' the pulp still has a dry substance content of approximately 35–50%. In connection with prior art technique, for example the one described in Norwegian Pat. No. 137.651, lye and water were added to the ozone treated pulp in a mixing vessel associated with the ozone treatment apparatus, in which vessel the pulp was diluted to a dry substance concentration of approximately 3%. Such a low dry substance concentration of the pulp entails a long maturation time, the dispersion of lye in the pulp being difficult and the diluted pulp requiring a relatively large space for treatment and storage.

In the rector plant according to the present invention the above problems from which the prior art are suffering, are avoided by using a maturation reactor 2' of the type which is illustrated in FIG. 1 and which will be further described in the following.

The maturation reactor 2' is characterized in that it constitutes a direct extension of the ozone reactor 1' and that in the area of the transition portion 3' it is provided with a plurality of nozzles 6' serving for supplying to the maturation reactor 2' a plurality of jets of primarily lye, but also jets of other chemical fluids. The light and fluffy ozone treated pulp which via the transition portion 3' falls down into the maturation reactor 2' and there forms a standing pulp column 10', will after it is mixed with the jets of lye, have a pulp consistency or dry substance content of approximately 15–30%. Thus, the addition of lye to the ozone treated pulp takes place when the pulp has a high content of dry substance, a fact which entails that the dispersion of lye in the pulp is carried out quicker and more uniform, the high dry substance concentration of the pulp also entailing that the maturation time required for the pulp to stabilize the properties gained during the ozone treatment and to adopt a suitable alkaline pH-value becomes substantially shorter than what is the case in the maturation process according to prior art, for example as described in Norwegian Pat. No. 137.651. Experiments have shown that by using the plant according to the invention there may be achieved a satisfactory maturation in the course of approximately 30 minutes, whereas in the maturation process described in Norwegian Pat. No. 137.651 a maturation time of approximately one hour or more must be counted upon.

The reason why the maturation time in the maturation reactor 2' becomes relatively short is that the driving potential controlling the diffusion process taking place in the pulp, is proportional to the pulp concentration during the reaction. Accordingly, a higher concentration of the pulp entails a quicker diffusion process and accordingly a shorter maturation time.

Preferably the light and fluffy ozonized pulp is mixed with so much alkalis, i.e. preferably lye, at the outlet of the ozonizer that the finished matured pulp stabilizes at a pH-value of approximately 6–7. The quantity of the added alkalis is determined by the quantity of ozone used for the ozonization of the pulp in the ozonizer, and the quantity of alkalis may preferably constitute approximately 60–70 weight-% of the ozone. A suitable pH-value for the pulp when leaving the ozonizer after being mixed with chemicals, is approximately 9–10, and this output pulp with then, after having gone through the maturation process, stabilize at a pH-value of approximately 6–7.

In the bottom section 4' of the maturation reactor there is provided a second set of nozzles 8' for the supply of diluting water which is mixed with the matured pulp 10' which after having resided in the maturation reactor 2' for a suitable period of time has achieved the desired degree of maturation. To obtain a best possible dilution the nozzles 8' may suitably be mounted around the circumference of the reactor portion so as to give the diluted pulp a rotating or whirling movement, and together with the not illustrated stirring means or mixers 11' arranged in the bottom section 4' contribute to an effective stirring of the matured pulp.

The diluted pulp is passed from the reactor 2' via the outlet 9' and direct to a subsequent not illustrated processing stage, for example a paper manufacturing machine.

The injection of liquid via the nozzles 6' may advantageously be accomplished so that the jets from the nozzles will screen the means for sucking out excess gas so as to obtain a scrubber effect.

In FIG. **1*b* a graph illustrates how the pH-value of the pulp varies at the various stages of the process. At the inlet of the reactor corresponding to point R in FIG. 1*b*, the pulp will have an acid pH-value, for example pH 5. During the treatment in the ozonizer 1' the pH-value of the pulp is reduced to 2–4, for example to 2.5 as indicated at the point S, the latter pH-value depending on the quantity of ozone used in the ozone treatment process. At the outlet of the reactor 1' the strongly acid pulp is mixed with inter alia lye to adopt a strongly alkaline pH-value in the range 8–11, for example pH 9 as indicated at the point T in the graph. On its way through the maturation reactor the pH-value of the pulp will once again decrease until the pulp at the outlet of the maturation reactor 2', that is at point U in the graph in FIG. 1*b***, stabilizes at a pH-value of approximately 6–7, preferably 6,5. The corresponding Figures of the solids content at the points referred to above will be as follows: at point R approximately 35–50%, at point S approximately 35–50%, at point T approximately 15–30% and at point U approximately 15–30%. Depending on whether the finished matured pulp is diluted or not, the solids content of the pulp will remain approximately at 15–30% or be further decreased.

In an alternative to the reactor plant illustrated in FIG. 1 this may comprise a transport path for the ozonized pulp which extends between the bottom of the ozone reactor and the bottom of an associated maturation reactor. The pulp is then loaded into the maturation reactor at the bottom thereof and is discharged therefrom at the top, the pulp at a suitable location in the transport path being mixed with lye to adopt an alkaline pH-value.

Figures 2, 3:
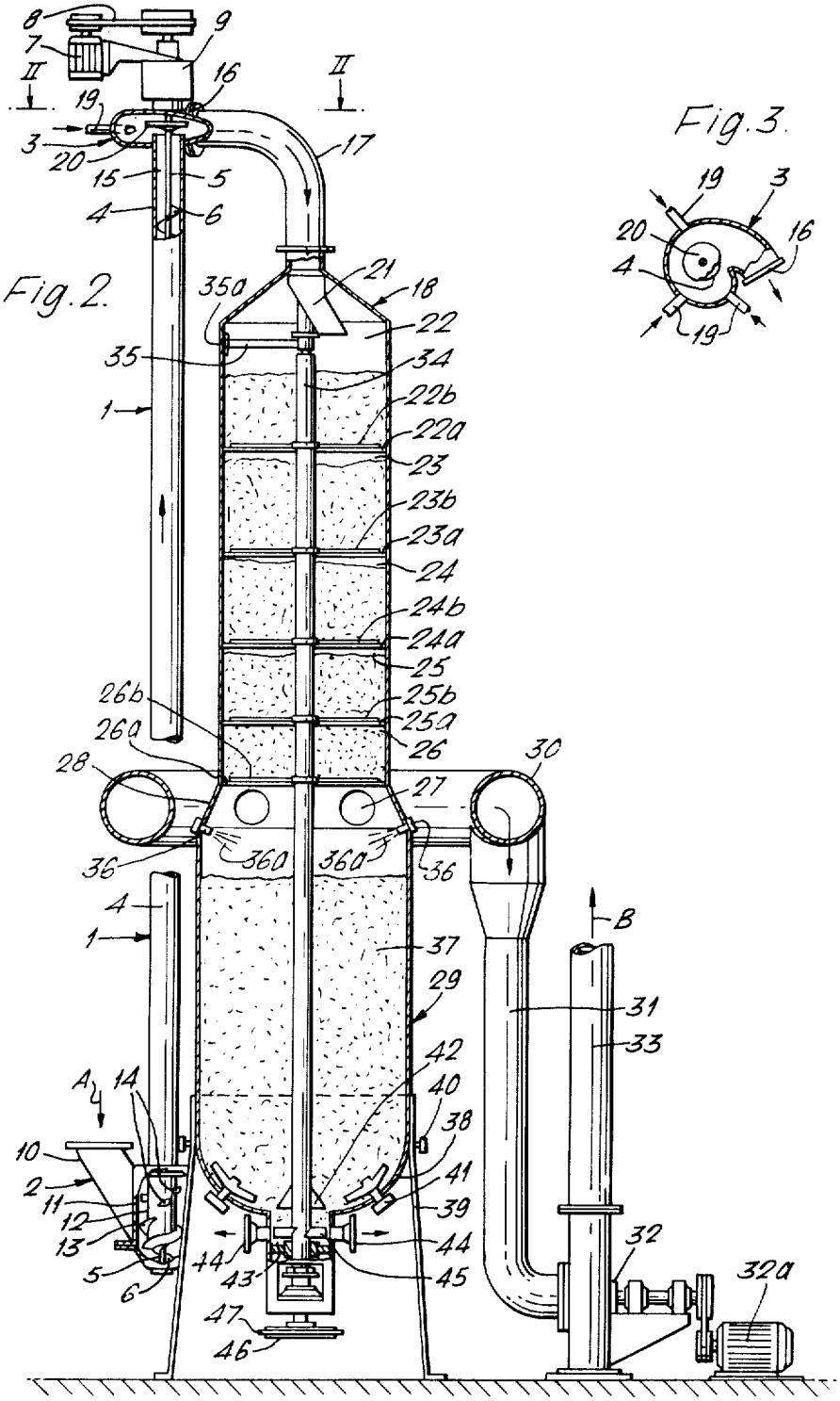
FIG. 2 is a more detailed layout of a reactor plant according to the invention.
FIG. 3 is a section along the line II—II in FIG. 2.

A more detailed embodiment of a reactor plant according to the invention is illustrated in FIG. 2.

The plant comprises a conveyor, more particularly a vertically arranged screw conveyor which is generally designated by 1. The conveyor 1 consists of a lower infeed member 2, an upper outfeed member 3 and a conveyor pipe 4 extending between the members 2 and 3. In the conveyor pipe 4 there is rotatably mounted a concentric shaft 5 which across the larger part of its length carries a conveyor screw 6. The shaft 5 is driven by a motor 7 via a V-belt transmission 8 and a gear 9.

The infeed member 2 comprises an infeed stub 10 which may be connected to a not illustrated conveyor means for the supply of finely divided bulk material, as this is indicated by the arrow A. The finely divided pulp is passed through the inlet stub 10 and into an infeed container 11 surrounding the lower part of the conveyer 1. In the infeed conveyer 11 there is provided a pipeshaped infeed means 12 which constitutes an extension of the conveyer pipe 4 and is provided with wings 13, 14. By not illustrated actuating means the infeed means 12 may be rotated in opposite direction of the conveyor screw 6, so that the wings 13, 14 pass the supplied material downwards and towards the centre of the portion of the conveyer screw 6 which is not covered by the infeed means 12, and in this manner prevents the material from being whirled out by the conveyer screw 6. The supplied material which fills up the infeed container 11, is conveyed through the conveyer pipe 4 as a uniform and suitably compressed pulp column to the outfeed member 3 provided at the top of the conveyer pipe 4. The conveyer screw 6 is terminated a distance ahead of the place where the conveyer pipe 4 extends into the outfeed member 3, as this is illustrated at the area 15 in FIG. 1.

The outfeed member 3 takes the form of a spiral or snailshell-shaped cover, as best illustrated in FIG. 3, and is provided with an outlet opening 16 joining the outlet pipe 17 connected to the top of an ozone reactor 18. Around the circumference of the outfeed member 3 there are provided supply conduits 19 serving for the supply of one or more fluids, e.g. ozone gas. In the area of the outfeed member 3 there is on the shaft 5 of the conveyer mounted a disc-shaped fluffer 20 rotating together with the shaft 5 and serving to give the advancing pulp column a light and fluffy consistency suitable for treatment by the gas supplied through the pipes 19.

Around the circumference of the outfeed member 3 the pipes 19 are arranged in such a number and in such positions that the supplied gas simultaneously with its mixing with the fluffed pulp, also imparts to the pulp a rotating movement and conveys it to the outlet opening 16. Aside from giving the pulp a rotating movement the supplied gas in the area of the fluffer 20 will also impart to the pulp a forceful whirling or turbulence so as to achieve an intimate mixing of gas and pulp. This whirl-/turbulence-effect also reduces the fan effect of the fluffer means, so that the pressure on the upper side, i.e. in the outfeed member 3, and the pressure on the lower side, i.e. in the infeed member 2, is approximately equal, preferably equal to atmospheric pressure. By the conveyer 1 the finely divided pulp, which is supplied to the infeed member 2 at the arrow A, can be passed into the outfeed member 3 as a column having such a length and such a compression that it forms a blocking for the gas supplied to the outfeed member 3 via the pipes 19. In order to achieve a satisfactory gas block there may suitably be utilized a comparatively long pulp column having a relatively low compression, the power requirement for the after-fluffing of the pulp in the outfeed member 3 then being very small, a fact which in turn involves that the shaft 5 can have a speed of less than 500 rpm, which means a reduced risk for heating and sparking.

In the ozone reactor 18 the finely divided, fluffed pulp, which is mixed with ozone gas, will be further treated either for the purpose of achieving a bleaching of the pulp or to increase the qualities of strength of the pulp.

The ozone reactor 18, which may be of the type which is further described in Norwegian Pat. No. 137.651, (U.S. Pat. No. 4,123,317) consists of a cylindrical container having a distribution means 21 mounted in an upper chamber 22. The bulk material or the finely divided fibrous pulp is supplied to the reactor 18 substantially continuously together with ozone gas, and the material is distributed in layers not only in the first-mentioned chamber 22, but also in subjacent chambers 23, 24, 25 and 26. During the treatment in the ozone reactor 18 each of the layers are supported by supporting means *22a—26a*, each of the supporting means being provided with apertures or slits having such a shape that they allow the fibrous or cellulose containing material which constitutes the pulp, to form bridges across the apertures. The gas, which is mixed with the fluffed material in the outfeed member 3 at the top of the conveyer 1, is allowed to flow continuously through the layers of bulk material across the entire cross section of the reactor, so that the gas will be in intimate contact with all the pulp particles. Possibly surplus quantities of ozone may via not further illustrated supply means be supplied in addition to the gas supplied through the pipes 19 in the outfeed member 3.

After the gas has passed through the layers of the finely divided material it is removed from the ozone reactor 18 through openings 27 in a transition portion 28, which connects the ozone reactor 18 with a maturation reactor 29.

The openings 27 in the transition portion 28 are surrounded by an annular suck out means 30 which via an outlet pipe 31 conveys excess gas out of the reactor 18 by a pump 32 driven by a motor **32*a*. The excess gas is passed on via a pipe 33, possibly for recirculation back to the system as indicated by the arrow B in FIG. 2**.

The displacement of the finely divided pulp through the ozone reactor 18 takes place by repeated but controlled breaking of mass bridges which have been formed across the apertures in the supporting means *22a–26a*, breaking means *22b–26b* which are allowed to sweep across the surface of the supporting means for breaking of the pulp bridges being provided for each supporting means.

Each of the breaking means are attached to a through-going central shaft 34 extending through both the ozone reactor 18 and the maturation reactor 29. In the chamber 22 there is mounted a scraping means 35 which at its free end carries a scraping member **35*a* serving for loosening pulp along the wall of the reactor. It is to be understood that the scraping means 35 is attached to the shaft 34** for rotation therewith.

The maturation reactor 29, which similarly to the reactor 18 consists of a cylindrical container, is in the area of the transition portion 28 provided with nozzles 36 serving for the supply of a plurality of jets 36*a* of various chemical fluids, for example lye, for further treatment of the ozone treated pulp in the maturation reactor 29. In the maturation reactor 29 the sprayed pulp forms a standing pulp column 37 which is passed through the maturation reactor 29 at a speed adapted to the desired residence or maturation time.

The light and fluffy ozone treated pulp, which via the transition portion 28 falls down in the maturation reactor 29 and there forms a standing pulp column 37, will after it has been mixed with the jets of lye have a pulp consistency or solids content of approximately 15–30%.

The maturation reactor 29 is provided with a lower semispherical portion 38 which is supported by a skirt-like supporting member 39. In the transition portion to the semispherical portion 38 there are provided nozzles 40 for supplying diluting water which is mixed with the matured pulp 37 which subsequent to its dwelling in the maturation reactor 29 for a suitable period of time, has achieved the desired degree of maturation. Through the water nozzles 40 so much dilution water is added that the dry substance concentration of the pulp is lowered to approximately 2–10%, preferably 5%. Suitably the nozzles 40 may be arranged around the circumference of the reactor portion 38 so as to give the diluted pulp a rotating or whirling movement and contribute to an effective stirring. In the portion 38 there are provided mixers 41 and on the shaft 39 there are mounted vanes 42 which together with the jets from the nozzles 40 and the mixers 41 have for their object to stir the pulp which is diluted in the semispherical portion 38. At the bottom of the maturation reactor 29 there is provided an outlet chamber 43 connected to outlet pipes 44 which convey the diluted pulp from the maturation reactor 29 and direct to a subsequent, not shown processing stage, for example a paper manufacturing machine. In the outlet chamber 43 there is on the central shaft 34 mounted vanes 45 which aside from stirring the matured and diluted pulp, also discharge the pulp through the pipes 44. At its lower end the shaft 34 is provided with a V-belt disc 46 which through a V-belt 47 is connected to a controllable, not illustrated actuating means, e.g. a variator.

The described transport and processing apparatus which is included in the described reactor plant, is especially favourable when used in connection with ozone treatment methods in which ozone produced from oxygen is used instead of ozone produced from air. When ozone is produced from oxygen it must be recirculated and it is then of great importance that the pulp supplied to the reactor does not contain air at all. If air nevertheless should enter the reactor this entails that the returned gas contains nitrogen compositions which contribute to a substantial reduction of the lifetime of the plant, the nitrogen compositions also complicating the ozone production.

When the pulp is supplied to the area of the ozone reactor in the form of a comparatively high pulp column having an appropriate compression the pulp column can be utilized as a pressure/gas barrier which thus reduces the supply of air to the system to a minimum.

It is of importance that the screw conveyor which is used, operates with a filling degree of so to say 100%, and a screw conveyer meeting these requirements is for example the type disclosed in NO-PS No. 127 182.

The fluffer means may then suitably be mounted on the driving shaft for such a screw conveyer for being rotated therewith, a fact which includes simple and cheap modifications of the screw conveyers available on the market and suitable for the above described purpose.

Figure 4:
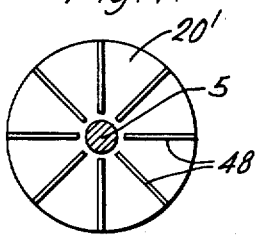
FIG. 4 is a diagrammatic view of a first embodiment of a fluffer.
Figure 5:
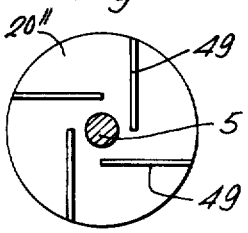
FIG. 5 is a diagrammatic view of a second embodiment of a fluffer.

The fluffer means can for example have the construction as illustrated in detail in FIGS. 4 and 5.

In FIG. 4 there is illustrated a disc-shaped fluffer means 20' which on the underside, i.e. on the side facing the pulp supplied to the outfeed member, is provided with eight radial lists or ribs 48. During rotation of the shaft 5 the ribs 48 will break up the pulp to a light and fluffy consistency.

In FIG. 5 there is illustrated a variant of a fluffer means 20'', in which this on the underside is provided with four ribs 49 which from the circumference extend in pairs parallel towards the area of the shaft 5.

Figure 6:
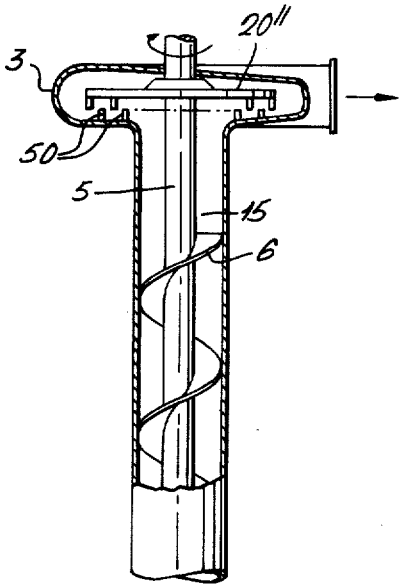
FIG. 6 is on a larger scale a view, partly in section, of details in the area of the outfeed member.
Figure 7:
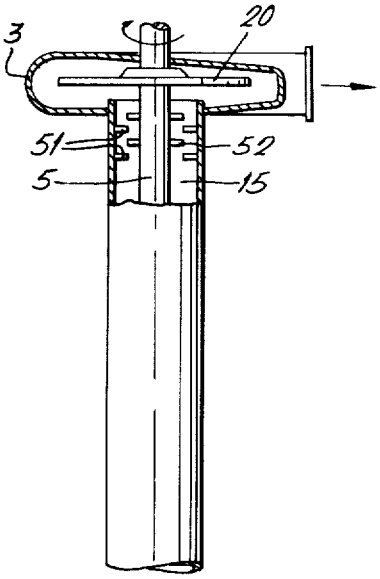
FIG. 7 is a view similar to FIG. 6 and depicts variants of details in the area of the outfeed member.

To avoid that the pulp is rotated together with the shaft 5 and the fluffer means mounted thereon there is in FIGS. 6 and 7 depicted expedients for this purpose. In FIG. 6 the expedients take the form of stationary tabs or lists 50 mounted on the inner wall of the outfeed member 3, whereas in FIG. 7 the rotation preventing expedients constitute tabs or ribs 51 attached to the inner wall of the upper area 15 of the conveyer screw 6 as well as second tabs 52 attached to the screw shaft 5.

Aside from the advantages described in connection with the conveyer and processing device carrying out the infeed and fluffing of the finely divided pulp, the reactor plant according to the invention also comprises advantages which can be summarized in the following points:

(1) The maturation of the pulp mixed with lye (NaOH) takes place at a high solids content and at an alkaline pH-value of the pulp. Thus, a more uniform and rapid maturation result is achieved than in connection with pulps having a lower dry substance content, the driving potential in diffusion pulp transport being proportional with the difference in the concentration of material during the reaction. A more uniform reaction is also achieved in that the pulp which first arrives in the maturation reactor, first leaves the reactor. This condition also contributes to facilitating the control and the monitoring of the parameters of the process, such as pH-value, residence time, etc.

(2) For mechanical pulps the apparatus according to the invention allows for a direct peroxide bleaching without auxiliary equipment, the nozzles provided in the transition portion between the ozone reactor and the maturing reactor being used for the supply of as well lye as other chemicals.

(3) The entire reactor plant, i.e. the plant comprising the ozone reactor and the maturation reactor requires a comparatively small space, since an ozone reactor of the type disclosed in Norwegian Pat. No. 137.651 has a large capacity per bulk unit due to the relatively short reaction time for the achievement of the desired ozone treatment, the use of the maturation reactor according to the invention also giving a large capacity per bulk unit due to a uniform and rapid maturation process.

(4) A rapid and controllable maturation at high consistency entails that the pulp of high concentration can be subjected to a rapid and effective ozone treatment (large ozone quantity per time unit) without the consequence of by-effects such as miscolouring of the pulp.

Experiments have shown that in a reactor plant of the type discussed in connection with FIG. 2 of the drawing, there has been achieved optimum qualities of the mechanical pulp after the finely divided mechanical pulp has been subjected to an ozone treatment of five minutes duration and a maturation time of approximately 30 minutes. In previously known plants the corresponding ozone treatment time was approximately 20 minutes, whereas the maturation time could be more than one hour.

The ozone treatment of cellulose containing pulps is implemented not only to increase the strength of the pulp, but also to give the pulp a brighter appearance. By bleaching for example chemical pulps in a plant comprising the two reactors described above, there has been achieved favourable results when the pulp is subjected to an ozone treatment of approximately 1 minute duration and with a maturation time of approximately 5 minutes.

What I claim is:

1. A method of treating finely divided fibrous pulp comprising the sequential steps of the continuous flow process of:

(a) supplying a finely divided fibrous pulp having a solids content of from about 35 to about 50 percent and a pH of about 5;

(b) treating the pulp with ozone until its pH decreases to from about 2 to 4 while maintaining its solids content;

(c) alkalizing the pulp by mixing it with alkali until the pH is temporarily increased to from about 8 to 12 and the solids content is reduced to from about 15 to about 30 percent; and (d) permitting the pulp to mature by diffusion, and without further mixing, until it reaches a stable pH of from about 6 to 7, the solid content of from about 15 to about 30 percent remaining unchanged.

2. The improvement of claim 1 wherein the quantity of alkali mixed with the pulp is from about 70 to 90 weight percent of the quantity of ozone.

3. The method of claim 2 wherein the alkali utilized is lye.

4. The method of claim 3 wherein the lye is admixed before application with at least one of bleaching chemicals and complex formers.

5. The method of claim 1 wherein the alkalizing step is performed by spraying the finely divided pulp with the alkali and wherein the pulp is permitted to mature by passing the pulp in a substantially vertical column through a container.

6. The method of claim 5 wherein excess ozone is withdrawn from the pulp prior to the alkalizing step and wherein the spraying of the pulp with alkali achieves a scrubber effect on the withdrawn ozone.

7. The method of claim 1 wherein the pulp is matured by charging it to the top of a vertical container after alkalizing and wherein the mature pulp is removed from the bottom of said container.

8. The method of claim 1 wherein the pulp is matured by charging it to the bottom of a vertical container after alkalizing and wherein the mature pulp is removed from the top of said container.

9. The method of claim 1 wherein the pulp is treated with ozone in a vertical column and wherein the pulp is processed before ozone treatment to a light and fluffy consistency.

10. The method of claim 9 wherein the ozone itself is utilized to move the light and fluffy processed pulp to the point at which ozone treatment is provided.

11. The method of claim 10 wherein the movement imparted is spiral in nature.

* * * * *